US010875065B2

(12) United States Patent
Mengel

(10) Patent No.: US 10,875,065 B2
(45) Date of Patent: Dec. 29, 2020

(54) METHOD FOR ROLLING A ROLLING MATERIAL AND ROLLING MILL

(71) Applicant: SMS group GmbH, Düsseldorf (DE)

(72) Inventor: Christian Mengel, Siegen (DE)

(73) Assignee: SMS group GmbH, Düsseldorf (DE)

( * ) Notice: Subject to any disclaimer, the term of this patent is extended or adjusted under 35 U.S.C. 154(b) by 318 days.

(21) Appl. No.: 15/768,108

(22) PCT Filed: Oct. 11, 2016

(86) PCT No.: PCT/EP2016/074258
§ 371 (c)(1),
(2) Date: Jul. 6, 2018

(87) PCT Pub. No.: WO2017/064017
PCT Pub. Date: Apr. 20, 2017

(65) Prior Publication Data

US 2018/0297094 A1 Oct. 18, 2018

(30) Foreign Application Priority Data

Oct. 15, 2015 (DE) ..... 10 2015 220 042
Aug. 9, 2016 (DE) ..... 10 2016 214 715

(51) Int. Cl.
*B21B 37/46* (2006.01)
*B21B 37/72* (2006.01)

(52) U.S. Cl.
CPC ..... *B21B 37/46* (2013.01); *B21B 37/72* (2013.01); *B21B 2275/04* (2013.01)

(58) Field of Classification Search
CPC . B21B 37/46; B21B 2271/02; B21B 2275/02; B21B 2275/05; B21B 2275/04; B21D 37/72
See application file for complete search history.

(56) References Cited

FOREIGN PATENT DOCUMENTS

| | | | |
|---|---|---|---|
| DE | 1427926 | A1 | 11/1968 |
| DE | 19726587 | A1 | 1/1999 |
| EP | 2796217 | A1 | 10/2014 |
| JP | S54-145350 | A | 11/1979 |

OTHER PUBLICATIONS

Office Action dated May 22, 2019 in corresponding Japanese Application No. 2018-519454; 10 pages.
International Search Report dated Jan. 2, 2017 of corresponding International Application No. PCT/EP2016/074258; 5 pgs.
Written Opinion of ISR dated Jan. 2, 2017 of corresponding International Application No. PCT/EP2016/074258; 7 pgs.
Written Opinion of IPEA dated Sep. 27, 2017 of corresponding International Application No. PCT/EP2016/074258; 15 pgs.
Letter to European Patent Office dated Apr. 3, 2017 of corresponding International Application No. PCT/EP2016/074258; 12 pgs.

*Primary Examiner* — Debra M Sullivan
(74) *Attorney, Agent, or Firm* — Maier & Maier, PLLC

(57) ABSTRACT

A method for rolling a rolling material in a rolling mill comprising at least one roll stand. A gap height of a rolling gap arranged between working rolls of the roll stand is set to be smaller than an in-feed thickness of the rolling material before contact of the rolling material with the working rolls. At least one driven working roll of the roll stand is driven at a desired rotational speed once the rolling material has reached the rolling gap, and the driven working roll is operated at a feed-forward rotational speed deviating from the desired rotational speed, until the rolling material reaches the rolling gap.

13 Claims, 2 Drawing Sheets

METHOD FOR ROLLING A ROLLING MATERIAL AND ROLLING MILL

FIELD

The invention relates to a method for rolling a rolling material in a rolling mill comprising at least one roll stand, wherein a gap height of a rolling gap arranged between working rolls of the roll stand is set to be smaller than an in-feed thickness of the rolling material before contact of the rolling material with said working rolls, wherein at least one driven working roll of the roll stand is operated at a desired feed-forward rotational speed once the rolling material has reached the rolling gap, and wherein the driven working roll is operated at a feed-forward rotational speed deviating from the desired rotational speed until the rolling material reaches the rolling gap.

The invention further relates to a rolling mill for rolling a rolling material, comprising at least one roll stand and at least one control unit and/or regulating unit that actuate or actuates the roll stand, wherein the control electronics and/or the regulating electronics are established for setting a gap height of a rolling gap arranged between working rolls of the roll stand to be smaller than an in-feed thickness of the rolling material before contact of the rolling material with said working rolls, for operating at least one driven working roll of the roll stand at a desired rotational speed once the rolling material has reached the rolling gap, and for operating the driven working roll at a feed-forward rotational speed deviating from the desired rotational speed until the rolling material reaches the rolling gap.

BACKGROUND

When metal rolling material, also referred to as slab, is rolled in coupled processes, speed disruptions and mass flow disruptions occur when the rolling begins in a roll stand of a rolling mill. A buildup of rolling torque is associated with a buildup of rolling force and is required for targeted re-shaping of the rolling material. The rolling torque or re-shaping torque is created by a working roll drive of the roll stand.

Usually, a working roll of a roll stand waits for the rolling material at a rotational speed $v_0$, which is required for a stationary re-shaping process. If the rolling material enters a rolling gap of the roll stand, the working roll drive of the roll stand takes over the re-shaping torque. Based on a usual regulation of the rotational speed of the working rolls of the roll stand, a short-term reduction in the rotational speed of the working rolls occurs in this case, until the rotational speed regulation has once again set the required desired rotational speed. Ahead of the roll stand, an accumulation of material builds up which should be collected by fixtures of a mass-flow regulation and tension regulation. Employed for this purpose are, for example, tension measuring rolls or loop lifters, by use of which regulating devices adjust the rotational speeds of the working rolls of adjacent roll stands until constant mass flow relationships and constant tension relationships are re-established.

In hot rolling mills and cold rolling mills, a common measure for reducing the requirements placed on the disruptive behavior of the mass-flow regulation at the start of rolling is a feed-forward control of the drop in rotational speed at the start of rolling. Here, one working roll or the drive of the working roll of a roll stand rotates before the start of rolling at a speed that is $\Delta v$ faster than under stationary rolling conditions. When the rolling material enters the roll stand and the onset of the drop in rotational speed occurs at the working roll thereof, this excess speed $\Delta v$ is removed and the roll stand obtains the speed specification under stationary conditions. In this way, it is achieved that the material accumulation at the inlet side of the roll stand is largely eliminated. This process is also referred to as tension buildup assistance. It is accepted here that the tension in the preceding process stage lies at a high level after entry, but this usually thereby represents an elevated process safety.

It is known that the drop in rotational speed at the working rolls of a roll stand and, accordingly, the accumulated rolling material length before the roll stand are dependent on the speed regulator settings (constant in normal operation) and on the rolling conditions and the required rolling torque. At high rolling torque, the drop in rotational speed is large and the required feed-forward control of the rotational speed of the working roll is likewise large. The difficulty in tension buildup assistance is to predict exactly the magnitude of the rotational speed feed-forward control $\Delta v$ and the optimal sequence over time.

When a rolling material enters a roll stand, the roll stand can be prepositioned to the required entry position, taking into consideration the expected rolling force, in such a way that, after the rolling gap has been filled with the material of the in-feeding rolling material and after the buildup in rolling force, the desired out-feeding thickness of the rolling material is produced directly. This opening of the roll stand from the position established in advance to the rolling position also leads to a contribution in the mass balance in the rolling gap when the rolling material enters it and further accelerates the in-feeding material of the rolling material. This acceleration of the in-feeding rolling material overlaps with the braking of the working roll drive. In many cases, the acceleration is subordinate to the latter. However, there are also cases in which the drawing of the rolling material into the rolling gap or the acceleration effect dominates and can be observed in, for example, the first roll stand of CSP (compact strip production) units.

An application with special relevance to the drawing-in conditions is represented by new equipment concepts involving endless production units (coupled casting and rolling), in which large slabs thicknesses of 70 mm to 160 mm, for example, should be cast and rolled out. In previously designed units, the leading edge of the slab is driven through the open first roll stand of a rolling mill at the start of rolling in order to enable the leading edge of the slab, which cannot be rolled out because of unfavorable temperature conditions and molded cold-extruded components of the sprue, to pass through. The first three roll stands of the rolling mill then come down on the slab after the leading edge of the slab has passed through and, within a few seconds, close onto the required intermediate thickness. Based on the large thicknesses at the leading edge of the slab, the material of the leading edge of the slab cannot be rolled out to the desired target thickness and the thereby generated wedge has to be detached in the following process and ejected, thereby reducing the output of an endless production unit.

In new strategies, the leading edge of the slab of an endless slab is intended to be rolled directly in the first roll stand of a multi-stand rolling mill. The non-rollable segment of the leading edge of the slab is detached behind the casting machine before the first roll stand by means of shears, for example. When the rolling material enters it, the first roll stand is then connected to the casting machine by way of the endless slab. An entry of a rolling material in a roll stand is here defined here in such a way that the rolling gap height prior to the entry of the rolling material in the rolling gap is smaller than the in-feed thickness of the in-feeding endless slab. Through the entry of the leading edge of the slab of the endless slab, it is achieved that, even at the beginning of the slab, the required decrease in thickness is set and the shearing of material or the creation of edge regions with transitional thickness is avoided, thereby increasing the output of endless production units.

Speed disruptions and mass flow disruptions at the start of rolling in the first roll stand of a multi-stand rolling mill can have reactive effects in the fluid region of the casting machine connected to the first roll stand via the endless slab. In this case, special requirements apply, because negative effects on the casting process, which ultimately could lead to a discontinuation of casting or to quality losses of the casting product, must be prevented. A slight disruption of the slab speed between the casting machine and the first roll stand is therefore indispensable.

SUMMARY

An object of the invention is to reduce changes in tension and/or changes in mass flow to the greatest extent possible in a rolling material in-feeding into a roll stand during an entry of a leading edge of the rolling material in the roll stand.

In a method according to the invention for rolling a rolling material in a rolling mill comprising at least one roll stand, a gap height of a rolling gap arranged between working rolls of the roll stand is set to be smaller than an in-feed thickness of the rolling material before contact of the rolling material with said working rolls, wherein at least one driven working roll of the roll stand is operated at a desired feed-forward rotational speed once the rolling material has reached the rolling gap, and wherein the driven working roll is operated at a feed-forward rotational speed deviating from the desired feed-forward rotational speed until the rolling material reaches the rolling gap. In accordance with the invention, the feed-forward rotational speed after the contact of the rolling material with the driven working roll is varied in such a way that the feed-forward rotational speed increases monotonically or decreases monotonically.

In accordance with the invention, the feed-forward rotational speed of the driven working roll deviating from the desired rotational speed is varied after a first contact of the rolling material in-feeding into the roll stand until a point in time at which the rolling material has reached the rolling gap. The rolling gap is hereby understood to mean the shortest distance between the driven working roll and a working roll that interacts with it. During this period time, a leading edge of the rolling material is already re-shaped by the working rolls until the rolling gap is filled with the rolling material, which, in the present case, means that the rolling gap has been reached. If the feed-forward rotational speed is higher than the desired rotational speed, then the feed-forward rotational speed after contact of the rolling material with the driven working roll is varied in such a way that the feed-forward rotational speed decreases monotonically. If the feed-forward rotational speed is lower than the desired rotational speed, then the feed-forward rotational speed after contact of the rolling material with the driven working roll is varied in such a way that the feed-forward rotational speed increases monotonically. In this way, changes in tension and/or changes in mass flow that are reduced to the greatest possible extent are produced in the region before the roll stand and, namely, even when almost no tension is present.

With the invention, the influence of a mass flow disruption on the rolling material that is feeding into the rolling gap is kept as small as possible when the rolling material enters the rolling gap, because, prior to the start of rolling, the rotational speed of the driven working roll is set by way of the feed-forward control of the rotational speed to be different in terms of the anticipated non-stationary relationships than under the conditions after the target thickness or out-feeding thickness of the rolling material is reached. In particular, before or at the start of rolling, a driven working roll of the first roll stand of a rolling mill can rotate slower or faster than the desired rotational speed. In the case of endless rolling (CEM, USP), before or at the start of rolling, the driven working rolls of the first three roll stands can rotate slower or faster than the desired rotational speed associated with the respective roll stand. In a CSP unit and in a hot rolling mill, before or at the start of rolling, the driven working rolls of the first two roll stands can rotate slower or faster than the desired rotational speed associated with the respective roll stand.

The variation of the feed-forward rotational speed in accordance with the invention starting from the first contact of the in-feeding rolling material with the driven working roll can take place in a defined period of time by use of, for example, a ramp function or another monotonically increasing or monotonically decreasing function. The variation of the feed-forward rotational speed thus begins with the first contact of the in-feeding rolling material with the driven working roll. In this case, the variation of the feed-forward rotational speed is preferably adjusted to the relationships in the rolling gap. A good compensation can be achieved when the period of the variation of the feed-forward rotational speed is adjusted to the period of time that begins with the first contact between the in-feeding rolling material and the driven working roll and ends when the rolling material has reached the rolling gap. By use of the pressed length l of the already re-shaped segment of the leading edge of the rolling material, said rolling gap filling time $t_F$ can be calculated approximately from the equation $t_F=l/v_0$ or $t_F=l/v_1$, wherein $v_0$ is the desired rotational speed of the driven working roll and $v_1$ is the in-feed speed of the rolling material feeding into the roll stand.

Advantageously, the variation of the feed-forward rotational speed is chosen in such a way that the length disruption $\Delta l$ that is to be expected before the roll stand is compensated for. This length disruption is composed of a constant amount that results from the behavior of the rolling material as it is drawn into the rolling gap and a load-dependent amount, that is, a torque-dependent amount, for the drop in rotational speed at the driven working roll, and an opening of the pre-positioned rolling gap. The compensation length is obtained from the integral balancing of the area between the point in time at which the rolling material comes into a first contact with the driven working roll and the point in time at which the rolling material reaches the rolling gap or fills it and the specified feed-forward rotational speed relative to the value of the desired rotational speed. The feed-forward rotational speed control $\Delta v$ in this case can be appropriately calculated for the time $t_V$ of the variation of the feed-forward rotational speed. If, during the variation of the feed-forward rotational speed, a simple ramp function is taken into consideration, $\Delta v=2\cdot\Delta l/t_V$ is obtained. It is possible to use, on the one hand, a negative feed-forward speed control for which the feed-forward rotational speed is slower than the desired rotational speed, when the accumulation of rolling material is small before the rolling gap or roll stand on account of a small drop in the rotational speed with a small rolling torque. On the other hand, a positive feed-forward speed control for which the feed-forward rotational speed is higher than the desired rotational speed is used when the drop in the rotational speed is dominant with a large load torque.

Accordingly, by means of the invention, it is possible to ensure a constant mass flow and a constant belt transport during an entry of the rolling material in the roll stand, said constant mass flow and constant belt transport being associated with a minimization of the reactive effect on a casting machine, which is connected upstream to the (first) roll stand of the rolling mill for forming an endless production unit.

The previously known solutions are applicable and in part tested for the usual fields of application, in particular for the rear roll stands of multi-stand hot rolling mills. However, they do not take into consideration the detailed relationships at the start of rolling in a preset rolling gap (rolling gap height<in-feed thickness of the rolling material) of the first roll stands of hot rolling mills, in particular in a first roll stand of an endless production unit. However, said detailed relationships are decisive for such rolling mills or production units for the speed behavior of the in-feeding material at the start of rolling. If the rotational speed of a driven working roll is adjusted in accordance with the invention to the detailed relationships, this can even lead to the fact that, for example, a driven working roll of a first roll stand of a multi-stand rolling mill of an endless production unit has to rotate more slowly before entry of the rolling material in said roll stand than the desired rotational speed in order to obtain a mass flow disruption that is as small as possible. Accordingly, known solutions for which the feed-forward rotational speed is higher than the desired rotational speed are not adequate and are accordingly unsuitable for said case of application.

The invention can be realized with very little expense and does not require additional space for alternative fixtures for maintaining a constant mass flow, such as, for example, a loop accumulator for compensating for mass flow disruptions, which would have to be designed for a rolling material thickness of up to 120 mm. In addition, in the method according to the invention, it is not necessary to generate an increased material reject, because the rolling material, including the leading edge thereof, is rolled completely. Furthermore, the invention makes possible a reduction in the requirements placed on the speed of a mass-flow regulation between a casting machine and a roll stand of a multi-stand rolling mill of an endless production unit, wherein the mass-flow regulation can adjust for nearly stationary relationships and is substantially relieved for the relatively fast entry in the first roll stand.

With the method according to the invention, it is possible for a rolling material to be rolled in the form of a slab and, in particular, an endless slab. For this purpose, the rolling mill can also have two roll stands or a plurality of roll stands. Because, in accordance with the invention, the gap height of the rolling gap arranged between working rolls of the rolling mill is set to be smaller before contact of the rolling material with said working rolls than an in-feed thickness of the rolling material, the rolling material is rolled from the leading edge thereof and hence is rolled completely, thereby reducing a material reject in comparison to production units in which the leading edge of the rolling material is initially passed through open roll stands and subsequently detached from the remaining rolling material. Therefore, both working rolls of the rolling mill that come into contact with the rolling material can be driven correspondingly, wherein a rotational speed of the respective working roll can be controlled and/or regulated in accordance with the invention. The desired rotational speed is tuned to an operation of the roll stand after entry of the rolling material has occurred at constant or stationary rolling conditions. The contact of the rolling material with the driven working roll and/or the reaching of the rolling gap can be recorded using a suitable sensor mechanism. For example, it is possible for at least one of these rolling states to be recorded by way of a recording of the rolling force instantaneously present at the roll stand, in that a rolling force value determined beforehand is assigned to the respective rolling state and the instantaneously recorded rolling force value is compared with the rolling force value determined beforehand.

In accordance with an advantageous embodiment, the feed-forward rotational speed is varied, after contact of the rolling material with the driven working rolls, by means of a feed-forward control function, which is determined by at least taking into consideration a rolling force to be expected and/or a rolling torque to be expected and/or an in-feed speed of the rolling material and/or a rolling gap geometry. In this way, it is possible to determine an optimal feed-forward control function $v=f(t)$ in terms of its time course and functional sequence, for which purpose information from conventional pass schedule calculations, such as the rolling force to be expected, the rolling torque to be expected, and the in-feed speed of the rolling material, can be employed. In this case, this information has to be available for the calculation of the feed-forward control function and has to be calculated in a suitable calculation unit for the respective pass schedule.

In accordance with another advantageous embodiment, the feed-forward rotational speed is predetermined in such a way that, from the contact of the rolling material with the driven working roll until the attainment of the stationary desired rotational speed, the integral over time between the feed-forward rotational speed and the desired stationary rotational speed gives a area that describes a predeterminable compensation length, which corresponds to the expected mass flow disruption at the rolling gap entrance at the start of rolling. The compensation length is preferably calculated from said area. The compensation length can be calculated by taking into consideration the rotational speed of the working roll and additional parameters that influence the mass flow at the start of rolling. In particular, the compensation length can be calculated by taking into consideration the rotational speed of the working roll at the start of rolling, the drawing-in behavior after contact of the rolling material with the working roll, and the vertical movement of the interacting working rolls on entry.

In accordance with another advantageous embodiment, the feed-forward rotational speed is predetermined by extending the monotonic plot of the feed-forward rotational speed in time within a rolling gap filling time that begins with the contact of the rolling material with the driven working roll and ends when the desired stationary rotational speed is reached. Preferably, the length of the rolling gap filling time is chosen to be greater than 50 ms.

In accordance with another advantageous embodiment, a rolling material speed of the rolling material is measured at a stand inlet of the roll stand and taken into consideration in the variation of the feed-forward rotational speed after contact of the rolling material with the driven working roll. Any disruption that remains in spite of the feed-forward rotational speed control and can be caused by changing and unknown frictional relationships in the rolling gap, for example, can be reduced further by measuring the actual rolling material speed at the stand inlet and by adjusting the variation of the feed-forward rotational speed of the driven working roll, by taking into consideration the measured rolling material speed.

In accordance with another advantageous embodiment, a power consumption of casting machine drives of a casting machine upstream of the rolling mill after contact of the rolling material with the driven roll is taken into consideration. Any disruption that remains in spite of the feed-forward rotational speed control, a disruption that may be caused by changing and unknown frictional relationships in the rolling gap, can be reduced further by measuring the power consumption of the casting machine drives and by adjusting the variation of the feed-forward rotational speed of the driven working roll, by taking into consideration the measured power consumption.

A rolling mill according to the invention for rolling a rolling material comprises at least one roll stand and at least one control unit and/or regulating unit that actuate or actuates the roll stand, wherein the control electronics and/or the regulating electronics are established for setting a gap height of a rolling gap arranged between working rolls of the roll stand to be smaller than an in-feed thickness of the rolling material before contact of the rolling material with said working rolls, for operating at least one driven working roll of the roll stand at a desired feed-forward rotational speed once the rolling material has reached the rolling gap, and for operating the driven working roll at a feed-forward rotational speed deviating from the desired rotational speed until the rolling material reaches the rolling gap. In accordance with the invention, the control electronics and/or the regulating electronics are established to vary the feed-forward rotational speed after contact of the rolling material with the driven working roll in such a way that the feed-forward rotational speed increases monotonically or decreases monotonically.

The advantages mentioned above in regard to the method are correspondingly associated with the rolling mill. In particular, the rolling mill can be used for carrying out the method in accordance with one of the above-mentioned embodiments or in accordance with any desired combination of at least two of said embodiments with one another. The rolling mill can also have two roll stands or a plurality of roll stands, which can be actuated by using the control unit and/or the regulating unit. The control unit and/or the regulating unit can have at least one data processing unit, such as, for example, a microprocessor, and at least one data storage unit.

In accordance with an advantageous embodiment of the control electronics and/or the regulating electronics, the feed-forward rotational speed is to be varied by means of a feed-forward control function and, beforehand, the feed-forward control function is to determine an in-feed speed of the rolling material, taking into consideration a rolling force to be expected and/or a rolling torque to be expected. The advantages mentioned above in regard to the corresponding embodiment of the method are correspondingly associated with said embodiment.

In accordance with another advantageous embodiment, the control electronics and/or the regulating electronics are established for predetermining the feed-forward rotational speed in such a way that, from the contact of the rolling material with the driven working roll until reaching of the desired stationary rotational speed, the integral over time between the feed-forward rotational speed and the desired stationary rotational speed gives an area that describes a predeterminable compensation length, which corresponds to the expected mass flow disruption at the rolling gap entrance at the start of rolling. The control electronics and/or the regulating electronics are preferably equipped for calculating the compensation length, by taking into consideration the rotational speed of the working roll and additional parameters that influence the mass flow at the start of rolling. The control electronics and/or the regulating electronics can be equipped for enabling calculation of the compensation length, by taking into consideration, in particular, the rotational speed of the working roll at the start of rolling, the drawing-in behavior after contact of the rolling material with the working roll, and the vertical movement of the interacting working rolls on entry.

In accordance with another advantageous embodiment, the control electronics and/or the regulating electronics are equipped to predetermine the feed-forward rotational speed in such a way that the monotonic plot of the feed-forward rotational speed extends in time within a rolling gap filling period that begins with the contact of the rolling material with the driven working roll and ends when the desired stationary rotational speed is reached. Advantageously, the length of the rolling gap filling time is greater than 50 ms.

In accordance with another advantageous embodiment, the rolling mill comprises at least one measurement unit, which is associated with the control unit and/or the regulating unit and is arranged at a stand inlet of the roll stand, for the measurement of a rolling material speed of the rolling material at the stand inlet, wherein the control unit and/or the regulating unit are or is equipped for taking into consideration the measured rolling material speed during the variation of the feed-forward rotational speed after contact of the rolling material with the driven working roll. The advantages mentioned above in regard to the corresponding embodiment of the method are associated with this embodiment.

In accordance with another advantageous embodiment, the control unit and/or the regulating unit are or is equipped to take into consideration, during the variation of the feed-forward rotational speed, a power consumption of casting machine drives of a casting machine upstream of the rolling mill after contact of the rolling material with the driven roll. The advantages mentioned above in regard to the corresponding embodiment of the method are associated with this embodiment.

BRIEF DESCRIPTION OF THE DRAWINGS

In the following, the invention will be explained, by way of example, on the basis of an exemplary embodiment with reference to the appended figures, wherein the features explained in the following, taken by themselves as well as in different combination, can represent an advantageous or enhancing aspect of the invention. Shown are.

DETAILED DESCRIPTION

Figure 1:
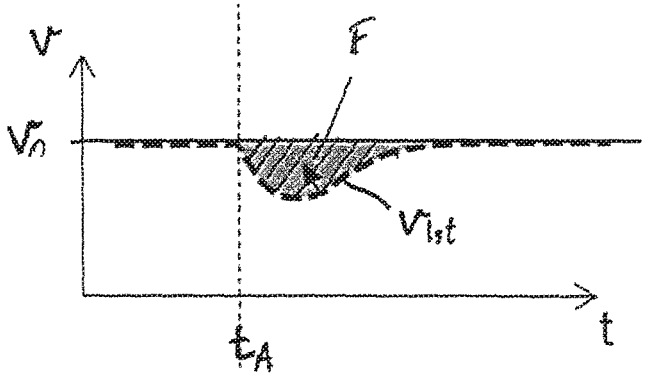
FIG. 1 an illustration, by way of example, of a plot of the rotational speed for a conventional rolling mill without feed-forward rotational speed control.

FIG. 1 shows an illustration, by way of example, of a plot of the rotational speed for a conventional rolling mill without feed-forward rotational speed control. Plotted is the rotational speed v of a driven working roll of a roll stand of the rolling mill versus the time t. At the point in time $t_A$, there occurs an entry of a rolling material in the roll stand. In addition, the actual rotational speed $v_{ist}$ is shown, wherein, after the entry, a short-term decrease in the actual rotational speed $v_{ist}$ can be seen. As a result of the entry, the rolling material accumulates, with the length of the accumulated rolling material being obtained from the area F between the desired rotational speed $v_0$ and the actual rotational speed $v_{ist}$.

Figure 2:
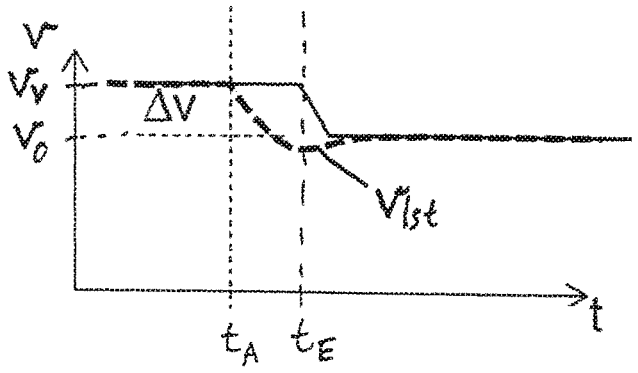
FIG. 2 an illustration, by way of example, of a plot of the rotational speed for a conventional rolling mill with feed-forward rotational speed control.

FIG. 2 shows, by way of example, an illustration of a plot of the rotational speed for a conventional rolling mill with feed-forward rotational speed control. Plotted is the rotational speed v of a driven working roll of a roll stand of the rolling mill versus time t. At the point in time $t_A$, there occurs an entry of a rolling material in the roll stand. The driven working roll is operated up to a point in time $t_E$ at a feed-forward rotational speed $v_V$ that is higher by Δv than the desired rotational speed $v_0$. After the point in time $t_E$, the feed-forward rotational speed $v_V$ is adjusted to the desired rotational speed. Shown, in addition, is the desired rotational speed $v_{ist}$. As can be seen, the drop in the rotational speed on entry of the rolling material in the roll stand is compensated for by said feed-forward rotational speed control.

Figure 3:
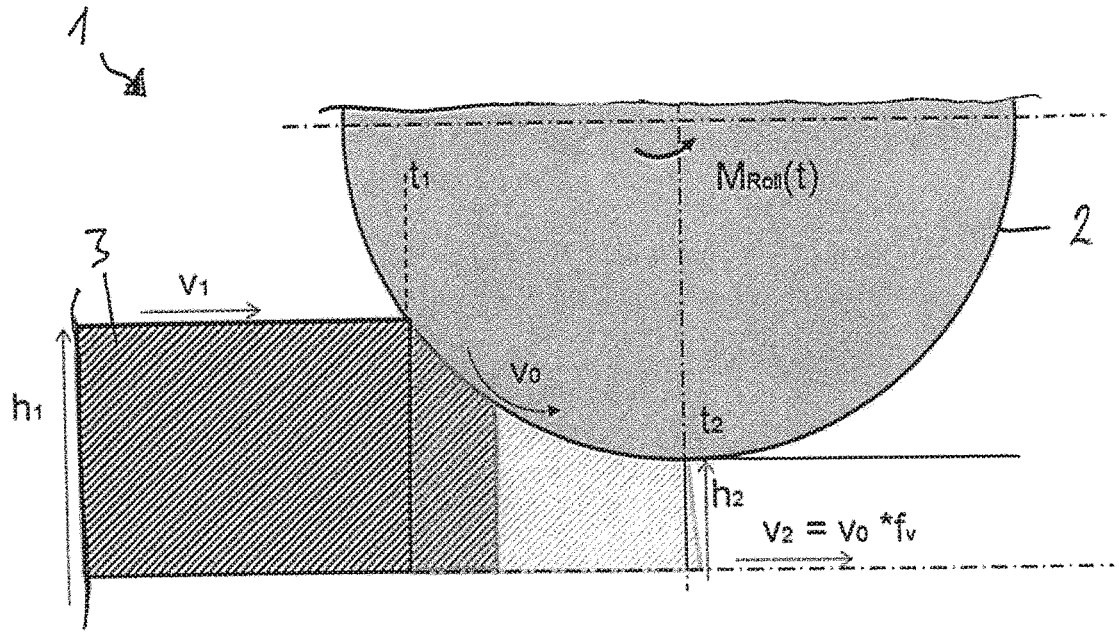
FIG. 3 a schematic illustration of speed relationships on entry of a rolling material in a conventional rolling mill.

FIG. 3 shows a schematic illustration of speed relationships on entry of a rolling material in a conventional rolling mill 1, of which, in FIG. 3, only one driven working roll 2 of a roll stand, which is not shown in more detail, of the rolling mill 1 is shown. A rolling material 3 is fed with an in-feed thickness $h_1$ and an in-feed speed $v_1$ into the roll stand and, at the point in time $t_1$, comes into contact with the driven working roll 2. The driven working roll 2 rotates at the rotational speed $v_0$ and with a torque $M_{Roll(t)}$. At the point in time $t_2$, the rolling material 3 reaches the rolling gap with the gap height $h_2$. The rolling material 3 is fed out of the rolling gap with the out-feed speed $v_2$, which is obtained from the equation $v_2=v_0 \cdot f_v$, where $f_v$ is the material advance at the rolling gap outlet.

The mass flow relationships on entry in the roll stand are complex and cannot be described solely through the speed behavior of the drive of the driven working roll 2. The driven working roll 2 waits with the working roll rotational speed $v_0$, which is required for the stationary rolling process. Because the material speed and the working roll rotational speed on leaving the rolling gap are nearly the same, the rotational speed of the driven roll, $v_0$, is nearly twice as large as the surface speed $v_1$ of the arriving rolling material 3 ($v_0=v_1 \cdot h_1/h_2/f_v$ with $h_1$=in-feed thickness of the rolling material, $h_2$=out-feed thickness of the rolling material, $f_v$=material advance at the rolling gap outlet) in the case of a great decrease in thickness of 50%, for example. If the in-feeding rolling material 3 impacts the driven working roll 2 of the rolling stand at the point in time $t_1$, the segment of the leading edge of the rolling material 3 impacting the working roll 2 is accelerated by the high surface speed of the working roll 2 and drawn faster into the rolling gap. At the point in time $t_2$, the rolling gap is completely filled. This effect is a function of the frictional relationships in the rolling gap and on the rolling gap geometry, but not on the rolling torque that arises.

Figure 4:
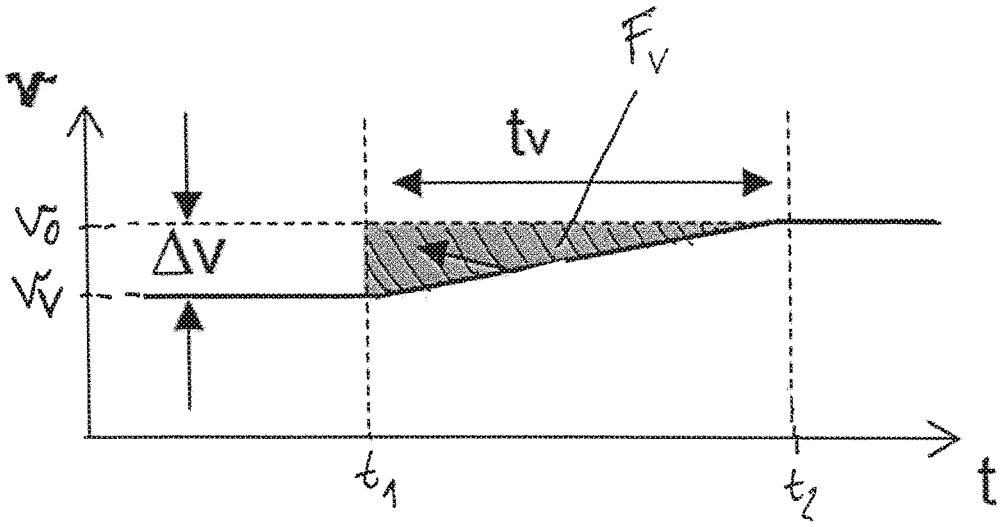
FIG. 4 an illustration, by way of example, of a plot of the rotational speed for an exemplary embodiment for a rolling mill according to the invention.

FIG. 4 shows an illustration, by way of example, of a plot of the rotational speed for an exemplary embodiment of the rolling mill according to the invention. Plotted is the rotational speed v of a driven working roll of a roll stand of the rolling mill versus time t. At the point in time $t_1$, a rolling material in-feeding into the roll stand comes into contact with the driven working roll, as is shown in FIG. 3. At the point in time $t_2$, the rolling material reaches the rolling gap. A gap height of a rolling gap arranged between working rolls of the roll stand is set in this case by said working rolls to be smaller than the in-feed thickness of the rolling material, as is shown in FIG. 3. The driven working roll of the roll stand is operated at a feed-forward rotational speed $v_0$ once the rolling material has reached the rolling gap. The driven working roll is operated at a feed-forward rotational speed $v_V$ that deviates from the desired feed-forward rotational speed $v_0$ until the rolling material reaches the rolling gap, wherein the feed-forward rotational speed $v_V$ is Δv slower than the desired rotational speed $v_0$. The feed-forward rotational speed $v_V$ is varied over a period of time $t_V$ after contact of the rolling material with the driven working roll in such a way that the feed-forward rotational speed $v_V$ increases monotonically. The feed-forward rotational speed $v_V$ is varied in this case after contact of the rolling material with the driven working roll by means of a feed-forward control function, which is determined by at least taking into consideration a rolling force to be expected and/or a rolling torque to be expected and/or an in-feed speed of the rolling material and/or a rolling gap geometry, in particular as a function of the in-feed thickness of the rolling material and on the rolling gap height. The area $F_V$ between the desired rotational speed $v_0$ and the feed-forward rotational speed $v_V$ between the points in time $t_1$ and $t_2$ is proportional to the length disruption due to the entry of the rolling material in the roll stand.

The feed-forward rotational speed can be predetermined in such a way that, from the contact of the rolling material with the driven working roll until the attainment of the desired stationary rotational speed, the integral over time between the feed-forward rotational speed and the desired stationary rotational speed gives an area that describes a predeterminable compensation length, which corresponds to the expected mass flow disruption at the rolling gap entrance at the start of rolling. The compensation length is preferably calculated from said area. The compensation length can be calculated by taking into consideration the rotational speed of the working roll and additional parameters that influence the mass flow at the start of rolling. In particular, the compensation length can be calculated by taking into consideration the rotational speed of the working roll at the start of rolling, the drawing-in behavior after contact of the rolling material with the working roll, and the vertical movement of the interacting working rolls on entry.

The feed-forward rotational speed can be predetermined in such a way that the monotonic course of the feed-forward rotational speed ($v_V$) extends in time within a rolling gap filling time that begins with the contact of the rolling material (3) with the driven working roll (2) and ends when the desired stationary rotational speed ($v_0$) is reached. Preferably, the length of the rolling gap filling time is chosen to be greater than 50 ms.

It is possible to measure a rolling material speed of the rolling material at a stand inlet of the roll stand and, during the variation of the feed-forward rotational speed, to take it into consideration after contact of the rolling material with the driven working roll. Alternatively or additively, during the variation of the feed-forward rotational speed, a power consumption of the casting machine drives of a casting machine upstream of the rolling mill can be taken into consideration after contact of the rolling material with the driven working roll.

The invention claimed is:

1. A method for rolling a rolling material in a rolling mill, comprising:

providing at least one roll stand having a gap height of a rolling gap arranged between working rolls of the at least one roll stand;

setting the gap height to be smaller than an in-feed thickness of the rolling material before contact of the rolling material with the working rolls;

operating at least one driven working roll of the working rolls of the at least one roll stand at a feed-forward rotational speed until the rolling material reaches the rolling gap, wherein the feed-forward rotational speed deviates from a desired rotational speed;

varying the feed-forward rotational speed starting from contact of the rolling material with the at least one driven working roll in such a way that the feed-forward rotational speed increases monotonically or decreases monotonically; and operating the at least one driven working roll at the desired speed once the rolling material has reached the rolling gap.

2. The method according to claim 1, wherein the feed-forward rotational speed is varied starting from contact of the rolling material with the driven working roll by a feed-forward control function that is determined at least by taking into consideration a rolling force to be expected and/or a rolling torque to be expected and/or an in-feed speed of the rolling material and/or a rolling gap geometry, as a function of the in-feed thickness of the rolling material and of the rolling gap height.

3. The method according to claim 1, wherein the feed-forward rotational speed is predetermined in such a way that, from the contact of the rolling material with the at least one driven working roll until attaining the desired rotational speed, an integral over time between the feed-forward rotational speed and the desired rotational speed gives an area that describes a predeterminable compensation length, which corresponds to an expected mass flow disruption at the rolling gap entrance.

4. The method according to claim 1, wherein the feed-forward rotational speed is predetermined in such a way that a monotonic plot of the feed-forward rotational speed extends in time within a rolling gap filling time that begins with the contact of the rolling material with the driven working roll and ends when the desired rotational speed is reached.

5. The method according to claim 4, wherein the length of the rolling gap filling time is chosen to be greater than 50 ms.

6. The method according to claim 1, wherein a rolling material speed of the rolling material is measured at a stand inlet of the at least one roll stand and the variation of the feed-forward rotational speed is adjusted based on the rolling material speed, starting from the contact of the rolling material with the at least one driven working roll.

7. The method according to claim 1, further comprising providing casting machine drives of a casting machine upstream of the rolling mill, measuring a power consumption of the casting machine drives, and adjusting the variation of the feed-forward rotational speed based on the measured power consumption, starting from the contact of the rolling material with the at least one driven working roll.

8. A rolling mill for rolling a rolling material, comprising:

at least one roll stand having working rolls with a rolling gap arranged therebetween, the working rolls including at least one driven working roll, the rolling gap having a gap height; and at least one control unit and/or regulating unit that actuate or actuates the roll stand, the control unit having control electronics and the regulating unit having regulating electronics;

wherein the control electronics and/or the regulating electronics are configured to set the gap height of the rolling gap to be smaller than an in-feed thickness of the rolling material before contact of the rolling material with said working rolls, to operate the at least one driven working roll at a desired rotational speed once the rolling material has reached the rolling gap, and to operate the at least one driven working roll at a feed-forward rotational speed deviating from the desired rotational speed until the rolling material reaches the rolling gap, wherein the control electronics and/or the regulating electronics are configured to vary the feed-forward rotational speed starting from the contact of the rolling material with the at least one driven working roll in such a way that the feed-forward rotational speed increases monotonically or decreases monotonically.

9. The rolling mill according to claim 8, wherein the control electronics and/or the regulating electronics are configured to vary the feed-forward rotational speed, starting from the contact of the rolling material with the driven working roll, by a feed-forward control function and, beforehand, the feed-forward control function is determined at least by taking into consideration a rolling force to be expected and/or a rolling torque to be expected and/or an in-feed speed of the rolling material, as a function of the in-feed thickness of the rolling material and of the rolling gap height.

10. The rolling mill according to claim 8, wherein the control electronics and/or the regulating electronics are configured to predetermine the feed-forward rotational speed in such a way that, from the contact of the rolling material with the driven working roll until attainment of the desired rotational speed, an integral over time between the feed-forward rotational speed and the desired stationary rotational speed gives an area that describes a predeterminable compensation length, which corresponds to the expected mass flow disruption at the rolling gap entrance.

11. The rolling mill according to claim 8, wherein the control electronics and/or the regulating electronics are configured to predetermine the feed-forward rotational speed in such a way that a monotonic course of the feed-forward rotational speed extends in time within a rolling gap filling time that begins with the contact of the rolling material with the driven working roll and ends when the desired rotational speed is reached.

12. The rolling mill according to claim 8, further comprising at least one measurement unit, which is associated with the control unit and/or the regulating unit and is arranged at a stand inlet of the at least one roll stand, for measurement of a rolling material speed of the rolling material at the stand inlet, wherein the control unit and/or the regulating unit are or is configured to measure the rolling material speed and to adjust the variation of the feed-forward rotational speed based on the rolling material speed, starting from the contact of the rolling material with the at least one driven working roll.

13. The rolling mill according to claim 8, further comprising casting machine drives of a casting machine upstream of the rolling mill, wherein the control unit and/or the regulating unit are configured to measure a power consumption of the casting machine drives and to adjust the variation of the feed-forward rotational speed based on the measured power consumption, starting from the contact of the rolling material with the at least one driven working roll.

* * * * *